US006720537B2

(12) United States Patent
Prager

(10) Patent No.: US 6,720,537 B2
(45) Date of Patent: Apr. 13, 2004

(54) DEVICE FOR DETECTING, MONITORING AND CONTROLLING THE OPERATING STATUS OF AN ELECTRIC IRON

(76) Inventor: Helmut Prager, Goethestrasse 24, Gross-Gerau (DE)

( * ) Notice: Subject to any disclaimer, the term of this patent is extended or adjusted under 35 U.S.C. 154(b) by 43 days.

(21) Appl. No.: 10/092,223

(22) Filed: Mar. 6, 2002

(65) Prior Publication Data

US 2002/0130123 A1 Sep. 19, 2002

(30) Foreign Application Priority Data

Mar. 7, 2001 (DE) ..... 101 10 993

(51) Int. Cl.[7] ..... H05B 1/02; D06F 75/00

(52) U.S. Cl. ..... 219/506; 219/248; 219/257; 38/82

(58) Field of Search ..... 219/506, 497, 219/501, 248, 240–241, 257, 499, 251; 38/82

(56) References Cited

U.S. PATENT DOCUMENTS

| | | | | |
|---|---|---|---|---|
| 4,580,038 A | | 4/1986 | O'Loughlin | |
| 4,590,363 A | * | 5/1986 | Bernard | 219/497 |
| 4,745,260 A | | 5/1988 | Albinger, Jr. et al. | |
| 4,935,600 A | | 6/1990 | Pachschwoll | |
| 4,960,975 A | * | 10/1990 | Weinbrecht | 219/241 |
| 5,380,983 A | * | 1/1995 | Cavada et al. | 219/501 |

FOREIGN PATENT DOCUMENTS

| | | | |
|---|---|---|---|
| DE | 32 14 233 C2 | | 10/1983 |
| DE | 37 38 155 A1 | | 6/1990 |
| DE | 4037115 | * | 5/1992 |
| DE | 4124187 | * | 11/1992 |
| DE | 42 23 338 A1 | | 1/1994 |
| DE | 195 23 010 A1 | | 11/1996 |
| DE | 19606507 | * | 8/1997 |
| DE | 199 01 011 C1 | | 5/2000 |
| JP | 4-183498 | * | 6/1992 |
| JP | 2002131107 | * | 5/2002 |

* cited by examiner

*Primary Examiner*—John A. Jeffery
(74) *Attorney, Agent, or Firm*—Quarles & Brady LLP

(57) ABSTRACT

Device for detecting, monitoring and controlling the operating status of an electric iron which is provided with at least one electric heating circuit having a heating element and a first power switch of the iron connected in series to the heating element. The device includes a control unit being provided as an integrated circuit, a second power switch which is controlled by the control unit depending on the operating status of the electric iron and which is connected in series with the electric heating circuit. An indicator unit having at least one indicator element indicates the heating status of the electric iron. A low voltage power supply for energizing at least one of the control unit, indicating unit, and second power switch. A low-impedance measuring resistance is connected in series with the second power switch, and provides an indirect detection means of the switching status of both power switches. The device further includes means for supplying a voltage drop arising at the measuring resistance as an input signal to the control unit for evaluating the input signal, and means for supplying a control signal to the indicator element for indicating the present heating status of the electric iron.

15 Claims, 2 Drawing Sheets

Fig. 1: PRIOR ART
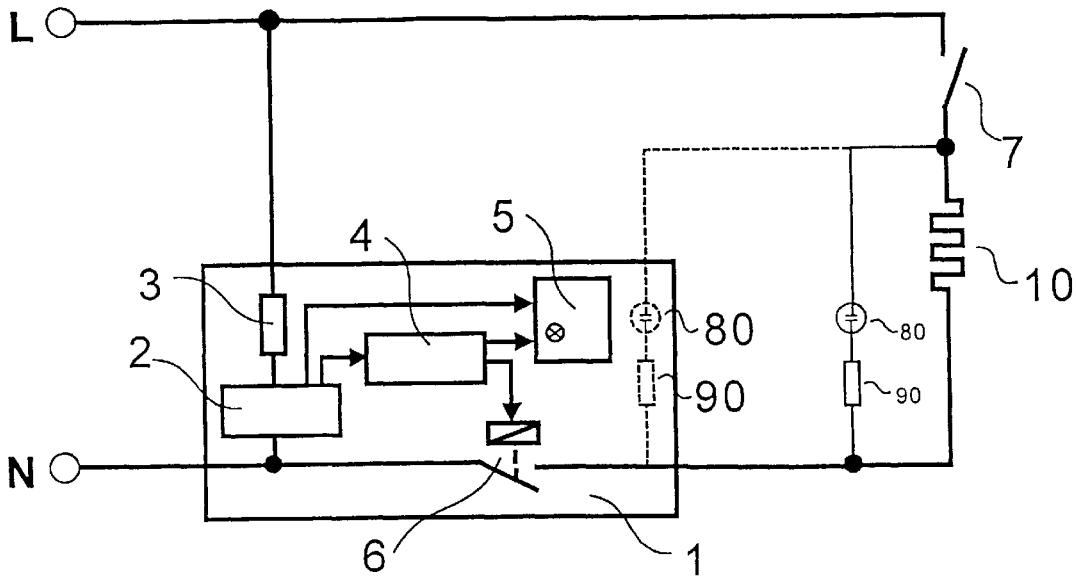
Fig. 2:
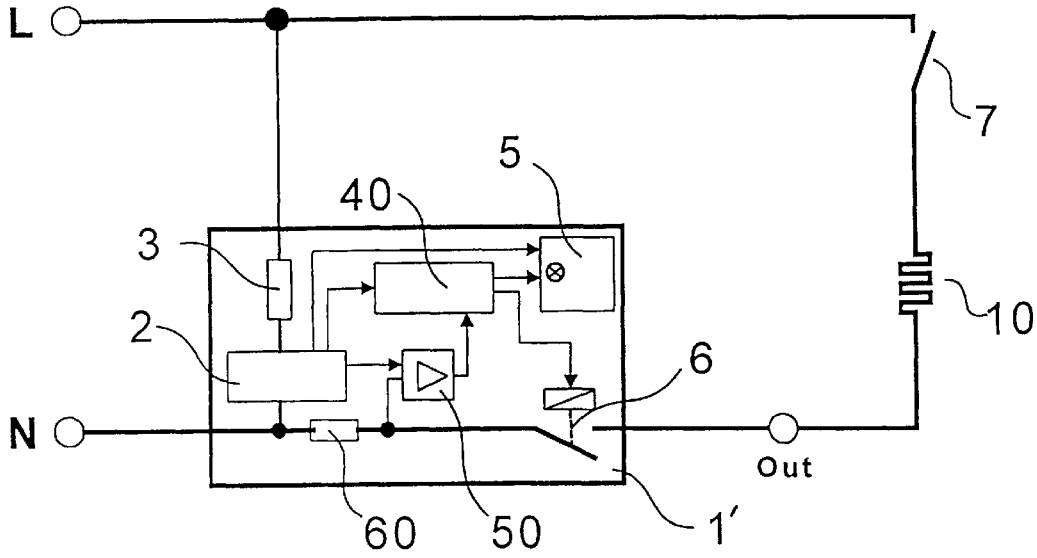

DEVICE FOR DETECTING, MONITORING AND CONTROLLING THE OPERATING STATUS OF AN ELECTRIC IRON

CROSS REFERENCES TO RELATED APPLICATIONS

This application claims the priority benefit of German patent application DE 101 10 993.8 filed on Mar. 7, 2001.

STATEMENT REGARDING FEDERALLY SPONSORED RESEARCH

Not Applicable

BACKGROUND OF THE INVENTION

The present invention relates to a device for detecting, monitoring and controlling the operating status of an electric iron or flat-iron. Commonly, the user is accustomed to receiving an optical signal, such as a light, indicating a supply of energy to a heating element of the electric iron. Usually, a glow lamp is used for this purpose, and the glow lamp, with a resistor connected in series therewith, is connected in parallel to the heating element.

Some commercially available steam irons furthermore comprise an electronic assembly which conducts and/or switches the heating current. Often, the electronic assembly is provided with additional optical or acoustic indicator means for indicating further characteristics of the operating status of the electric iron. The indicator means are controlled by a control unit provided in the electronic assembly which also comprises a low voltage power supply for energizing the additional indicator means and the control unit.

FIG. 1 shows a circuit diagram of a prior art steam iron which is provided with the above mentioned glow lamp indicator and an electronic assembly having additional indicator means. The circuitry comprises a so-called safety shut-off device such as, for example, implemented in a steam iron TDA 7550 of Bosch.

As shown in the circuit diagram of FIG. 1, the electronic assembly 1 comprises a low voltage power supply 2 which is energized by the line voltage supply L, N without galvanic isolation via an impedance 3 connected in series therewith. The low voltage power supply energizes a control unit 4 and a LED-indicator unit 5. The control unit 4 controls a power switch 6 which is a component of the electronic assembly 1, and is connected in series with an electric heating circuit L, 7, 10, N of the iron for opening the electric heating circuit.

The output of the control circuit 4 driving the power switch 6 is depending on delay timers (not shown), optionally in combination with a sensor system (not shown) for detecting different positions (upright, horizontal) and/or movements of the electric iron or flat iron. The present operating status of the electronic assembly 1 and, hence, of the iron, is displayed by indicator unit 5 which comprises a light-emitting diode providing an alarm indication by flashing when the power switch 6 has been opened by means of control unit 4 depending on the delay timers and/or the movement and position status sensor.

The electric heating circuit of the iron comprises a heating element 10 and a power switch 7 being connected in series therewith and constituting the primary ON/OFF-switch for the heating element 10. Power switch 7 is provided outside of the electronic assembly 1 and, for this reason, is called hereafter "external" power switch. The external power switch 7 corresponds to the thermostat at the iron sole and is switched (closed and opened) by the usual thermostat adjustment with a temperature sensor and a manually selectable temperature range.

The power switch 6 being integrated in the electronic assembly 1 and, for this reason, being called hereafter "internal" power switch, allows a safety shut-off of the energized iron in addition to the thermostatically controlled ON/OFF-switching by means of external power switch 7. The safety shut-off is initiated a predetermined fixed time after an initial switch-on of the iron's thermostat or when the above mentioned position and movement sensor system has not detected a movement of the iron over a predetermined time period. The above alarm indication within indicating unit 5 is exclusively given when the heating element current can no longer flow due to a forced shut-off of the heating element current by controlled opening of the internal power switch 6.

A glow lamp 80, together with a series resistor 90, is connected in parallel to the heating element 10. The glow lamp 80 illuminates when the external power switch 7 in the form of the thermostat of the iron soleplate is switched on provided that the internal power switch 6 is closed. Hence, glow lamp 80 indicates whether a voltage is applied to the heating element 10 or not. Commonly, glow lamp 80 and associated dropping resistor 90 are provided outside the electronic assembly 1. In case of the above mentioned steam iron of Bosch, the glow lamp 80 is provided in the rear left portion of the grip handle. As indicated in dashed lines, the glow lamp can also be mechanically integrated into the electronic assembly 1.

As known, glow lamps are very sensitive to climatic changes. Furthermore, glow lamps can only be energized from the line voltage via a high-resistance dropping resistor. Even in case the glow lamp would be replaced by a light-emitting diode being energized by means of the low voltage power supply of the electronic assembly it would be necessary to provide a voltage tap between the external power switch 7 and the heating element 10.

BRIEF SUMMARY OF THE INVENTION

It is a general object of the invention to provide a reliable and low-priced device for detecting, monitoring and controlling the operating status of an electric iron.

According to a first aspect, the invention provides a device for detecting, monitoring and controlling the operating status of an electric iron which is provided with at least one electric heating circuit having a heating element and a first power switch of the iron connected in series to the heating element. The device includes a control unit being provided as an integrated circuit. A second power switch which is controlled by the control unit depending on the operating status of the electric iron is connected in series with the electric heating circuit. An indicator unit having at least one optical indicator element indicates the heating status of the electric iron. A low voltage power supply energizes at least one of the above units. A low-impedance measuring resistance is connected in series with second power switch, and provides an indirect detection means for the switching status of both power switches. The device further includes means for supplying a voltage drop arising at the measuring resistance as an input signal to the control unit for evaluating the input signal, and means for supplying a control signal to the indicator unit for indicating a present heating status of the electric iron by means of the indicator unit.

Accordingly, the inventional device avoids the common series connection of a glow lamp and resistor in parallel to the at least one heating element. In addition, the wiring in the form of a voltage tap "behind" the thermostat i.e. between the first power switch and the heating element is avoided. By means of detecting a voltage drop on the measuring resistance the switching status of the first or thermostatic power switch of the iron and of the second or internal power switch of the electronic assembly, as well as, the heating status of the electric iron and its heating element(s) are indirectly detected. Therefore, the heating status of the electric iron and its heating element(s) can be indicated by an indicator element of the indicator unit. This solution is a low-cost solution but nevertheless very reliable and any break and malfunction of the heating element can be detected. In contrast thereto, the glow lamp 80 of FIG. 1 indicates a voltage even in case of a current interruption within the heating element 10 itself and thus falsely indicates supply of energy to the heating element.

Furthermore, the measurement of the current through the low-impedance measuring resistance allows a more refined analysis of the present status of the electric iron. For example, the control unit of the electronic assembly can detect by analyzing the current value of the measured heating current whether or not a plurality of heating elements connected in parallel to one another operate correctly. It is also possible to detect a failure of the second or internal power switch controlled by the control unit. Likewise, the control unit can check and monitor a safety shut-off function effected by the internal power switch. In addition to taking into account the measured heating current, the control unit can analyze any sensor signals and/or timing signals supplied thereto or generated therein and can produce correspondingly adapted control signals for controlling the indicator unit and/or the internal power switch of the electronic assembly.

According to a further aspect, the above mentioned indicator element is provided for indicating that a heating current is flowing through the at least one heating element. Hence, the indicator element performs the function of the glow lamp 80 of FIG. 1 without the disadvantages of this prior art embodiment. The indicator element, preferably a light-emitting diode, constitutes a cost and space saving solution for providing a user with the common visual light signal appearing when the electric iron has been plugged in and disappearing when the electric iron has reached a temperature called for by the thermostatic power switch.

According to an alternative embodiment the indicator element is provided for indicating that the desired operating temperature of the iron has been reached only after a predetermined number of ON/OFF-switching cycles have been counted in the form of voltage drop cycles on the low-impedance measuring resistance. Thus, the user starts ironing only after utilizing the full heat capacity of the iron sole.

According to a further aspect, an amplifier is provided for amplifying the voltage drop on the low-impedance measuring resistance. The amplifier is preferably provided in the integrated control unit. In a preferred embodiment, the control unit is implemented in form of a single integrated circuit, preferably provided in form of an application specific integrated circuit (ASIC). Preferably, the inventive low-impedance measuring resistance is provided within the electronic assembly and a voltage tap of the resistance is connected to a signal input of the amplifier integrated in the control unit.

The impedance value of the low-impedance measuring resistance is preferably selected such that the dissipated power is lower than 1 Watt and preferably not higher than 0.5 Watt at the maximum possible value of the heating current. Accordingly, the impedance value should be lower than 4 mOhm at a maximum heating current flow of 16A.

According to a further aspect, the inventive low-impedance measuring resistance, on its one connection side, is connected to ground and, on its other connection side, is connected to a measuring signal input of the integrated control unit. Preferably, the low-impedance measuring resistance is formed by a section of a heating current conductor path of the electronic assembly. In this manner, the heating current measurement can be implemented with a minimum of additional electronic connections and nearly without warming up the circuit board of the electronic assembly in an undue manner.

Furthermore, it was confirmed that the additional function of evaluating the measured voltage drop on the low-impedance measuring resistance does not impair the performance of the IC circuit, for example, its conversion function.

According to a further aspect of the inventional device, an additional input to the control unit comprises one or more signals generated by one or more sensors sensing position and/or movement of the electric iron in order to shut-off the heating current via the internal power switch whenever the electric iron has not been manipulated over a predetermined time period.

According to a further aspect of the inventional device, an input to the control unit can be a signal generated by a timer in order to shut-off the electric heating circuit via the second power switch when a predetermined considerably long time period has elapsed after the first power switch has been initially switched ON. This time period can be monitored by the inventional sensing of the voltage drop on the measuring resistance and it is, for example, possible to detect, by analyzing the ON/OFF-switching time pattern of the first power switch, that the electric iron has not been manipulated over the predetermined time period. If a user forgets to disconnect the iron from the line voltage supply the heating current is automatically shut-off after one hour or the like which constitutes a time period being longer than usual interruptions during ironing. Of course, any timers can be implemented within the control unit itself.

The invention is mainly implemented by the electronic assembly. Preferably, this assembly is designed in form of an integrated module or unit. Preferably, it has only two terminals to connect it in series with the heating circuit apart from a connection to the line voltage supply for energizing the low voltage power supply integrated within the electronic module.

A preferred embodiment of the invention will now be described referring to the attached drawings.

BRIEF DESCRIPTION OF THE DRAWINGS

FIG. 1 is a block diagram of an electric heating circuit and an electronic assembly of an electric iron according to the prior art;

FIG. 2 is a block diagram of an electric heating circuit and an electronic assembly of an electric iron according to an embodiment of the present invention.

DETAILED DESCRIPTION OF THE PREFERRED EMBODIMENTS

Figure 3:
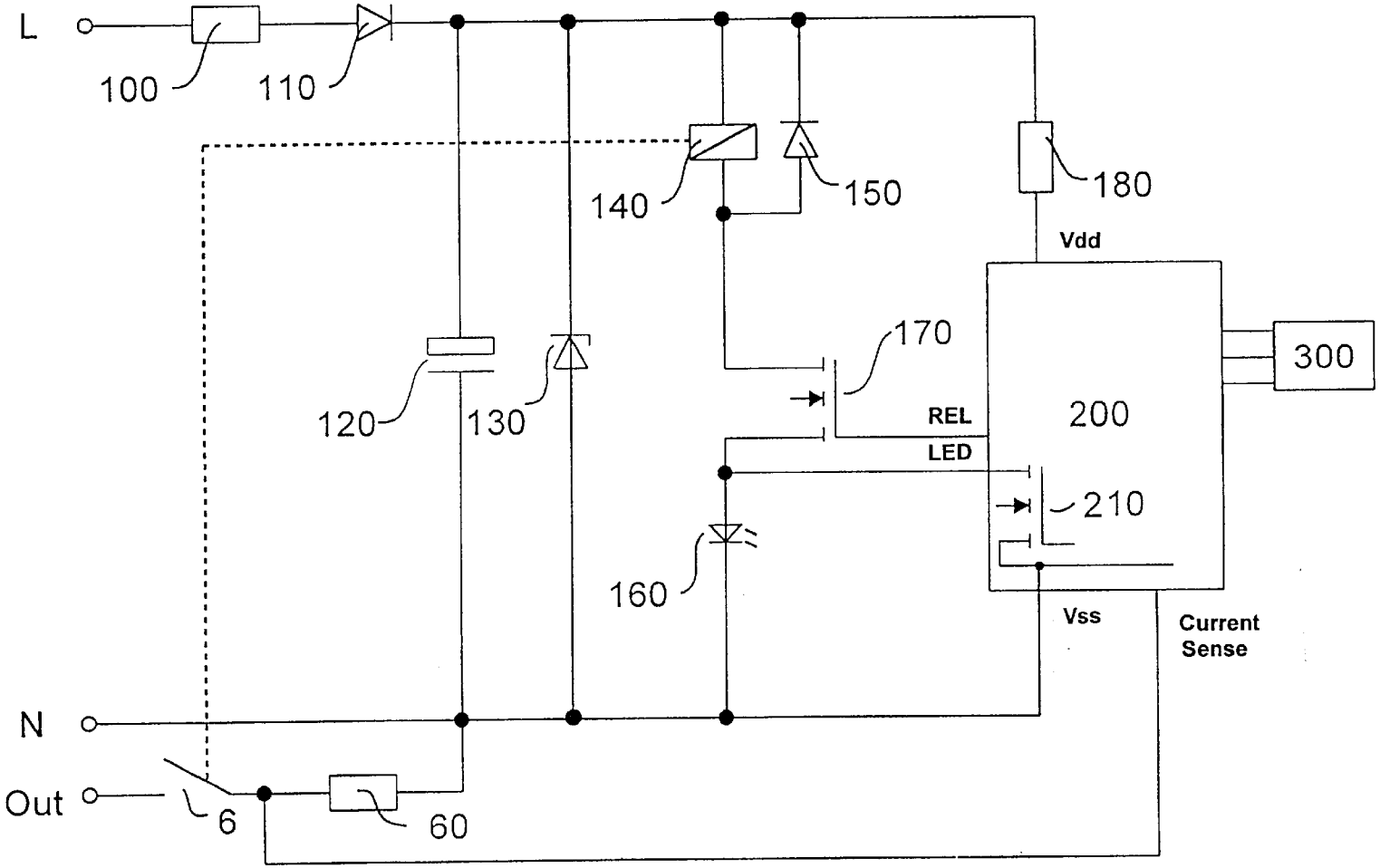
FIG. 3 shows a more detailed circuit diagram of an implementation of the electronic assembly shown in FIG. 2.

The inventional device according to FIG. 2 comprises an electronic assembly 1' which has a low voltage power supply 2, a dropping impedance or resistor 3, a control unit 40, an indicator unit 5 and an internal power switch 6. In addition to these components, already comprised in the electronic assembly 1 shown in FIG. 1, and described in connection therewith, the electronic assembly 1' shown in FIG. 2 has a low-impedance measuring resistance 60 and an amplifier 50.

The control unit 40 and the amplifier 50 are combined in an integrated circuit. The integrated circuit controls the internal power switch 6, for example, in a manner as outlined above for the prior art system of FIG. 1. The low-impedance measuring resistance 60 is connected in series to internal power switch 6 of the electronic assembly 1' and the external thermostatic power switch 7 of the iron. Furthermore, the low-impedance measuring resistance 60 is connected to an input of control unit 40 via the amplifier 50. The low voltage power supply 2 supplies energy to the components 5, 40, 50 of the electronic assembly 1'.

Provided that both power switches 6 and 7 are closed, the load current flowing through the electronic assembly 1' is defined by the supply voltage of the line voltage supply L, N and the resistance value of a heating load or heating element 10. The flowing current causes a voltage drop across the low-impedance measuring resistance 60. This voltage drop is amplified by the amplifier 50 integrated in the control unit 40.

According to the shown embodiment of the invention, the control unit 40 has the function of signaling to the user a current flow through heating element 10. The control unit 40 can also, alternatively, or in addition to, indicate any present heating conditions and/or other present conditions which are derivable from the simple event whether or not a current flow is detected at all and/or derivable from the value of the current sensed by the voltage drop and/or derivable from the duration of periods of current flow and non-current flow. This signaling or indicating function is performed by means of the indicator unit 5. For example, provided that both switches 6 and 7 are closed, indicator unit 5 indicates by means of an indicator element, preferably a light-emitting diode, that heating current is flowing.

In an alternative or additional solution, control unit 40 can determine that a predetermined number of heating cycles have been performed by opening and closing of thermostatic switch 7 and that, accordingly, the desired iron temperature has indeed been reached and, then, can control indicator unit 5 to indicate this heating condition by lightening an indicating element. A further alternative can combine both functions in the following manner: an indicator element of indicator unit is illuminated when first detecting current flow through heating element 10 and is extinguished after detection of said predetermined heating cycles when it is certain that the desired heating temperature has been reached.

The above inventive functions are carried out by control unit 40 in addition to the control of internal power switch 6. Internal power switch 6 is, for example, controlled in dependency of the status of position and/or movement sensor means (not shown) mentioned above and/or of timers provided within the control unit and/or circumstances derived from sensing a voltage drop on the low-impedance measuring resistance 60 as explained in connection with the indicating function.

The indicator unit 5 can have further indicator elements in addition to the indicator element for indicating the heating status of the iron. As already mentioned above, an indicator element can provide an alarm indication by flashing when the power switch 6 has been opened by means of control unit 40 after non-use of the energized iron over a longer time period. Before initiating the alarm status, control unit 40 can provide different delay times, for example: a long delay time when the iron is standing upright, and a short delay time when the iron is in horizontal position standing on its heated base. The same light-emitting diode can be used for indicating the heating condition and heating current and for giving the flashing signal when switch 6 is opened, by being correspondingly controlled by control unit 40. This alarm indication is initiated only when, due to a shut-off of the heating current by means of the safety power switch 6, no heating current to be indicated can flow. Accordingly, the indicator means can provide an exact indication with one or a plurality of indicator elements whether the current is no longer flowing due to a forced shut-off by means of switch 6 or due to opening of the thermostatic switch 7.

The amplifier 50 amplifies the voltage drop across the low-impedance measuring resistance 60 caused by a load current to a voltage level which can be analyzed by control unit 40. The low-impedance measuring resistance is preferably selected such that the dissipated power is lower than 1 Watt and preferably not higher than 0.5 Watt at the maximum possible value of the heating current (e.g. 16A in Germany). The amplifier can be a comparator with a switching threshold of approximately 2 mV to 10 mV. The low-impedance measuring resistance is preferably formed by a section of a heating current conductor path on the circuit board of the electronic assembly 1'. Alternatively, one could use a portion of the wiring leading to the electronic unit or contact resistance of the internal safety power switch. The first alternative solution however requires an additional measuring line and the second alternative solution needs in addition a high impedance serial resistor to hold off the line voltage when internal power switch 6 is open.

As shown in FIG. 3, an implementation of an electronic assembly or device according to the present invention has terminals N, L, and OUT which are connected to the electric heating circuit and the line voltage supply. The low voltage supply for an integrated circuit 200 in the form of an ASIC is derived from the line voltage supply L, N of 120V/60 Hz via a one-way rectifying means 110 and a dropping resistance 100 of 4.7 kOhm. The voltage at a capacitor 120 of 33 $\mu$F is limited to a voltage of 33V by means of a zener diode 130. The rectified supply voltage is supplied to the integrated circuit 200 via a resistor 180 of 56 kOhm and the integrated circuit limits its operating voltage by means of an integrated voltage regulator to 5V. The operating voltage of 5V is buffered by means of a buffer capacitor of 1 nF (not shown). The integrated circuit 200 analyzes the signals of a position sensor 300 besides other signals. The integrated circuit is adapted for supplying current to a coil 140 of a relay in dependency of the timing of the counter group of an integrated timer. This is effected by means of an external MOS-Fet transistor 170 which is connected to the relay coil 140. The relay coil 140 has an impedance of 3600 Ohm. A free running diode 150 is connected in parallel to the relay coil 140.

Current is flowing from the source terminal of transistor 170 via a light-emitting diode to N which serves as the reference potential of the circuit. Furthermore, the light-emitting diode 160 is connected to a MOS-Fet transistor 210 provided in the integrated circuit 200. Provided that the relay coil 140 is energized by the supplied current, the light-emitting diode 160 can be switched on and off by means of the MOS-Fet transistor 210. When the internal safety power switch 6 is closed and a heating current of, for example 6A, is flowing through the low-impedance measuring resistance 60 the resulting voltage drop at resistance 60 (12 mV in the present case) is amplified by a comparator (not shown) having a switching threshold of 8mV and being provided in the integrated circuit 200. The integrated circuit then starts with further processing of the amplified signal.

The circuit of FIG.3 can be set up such that the internal power switch 6 is closed in case of current supply to the relay coil 140. The light-emitting diode 160 can then, in this relatively simple control mode, indicate whether a heating current is flowing or not. By using a so called normally closed contact relay, the circuit can alternatively be set up such that the internal power switch 6 is open in case of current supply to the relay coil 140. The light-emitting diode 160 can then signal a forced safety shut-off and confirm whether the internal power switch 6 has in fact opened as instructed by the integrated circuit 200 or not.

As mentioned above, the integrated circuit 200 can process the voltage drop at measuring resistance 60 in a more sophisticated manner by detecting predetermined numbers of heating cycles before energizing the relay coil 140 for initiating a light signal or, for example, by detecting undue load current increase or decrease and correspondingly operate the internal safety power switch 6 and/or a flashing alarm indicator.

The advantage of the present circuit embodiment is that in case of current supply to the relay coil, the impedance of the relay coil 140 serves as dropping resistance or pre-resistance for light emitting-diode 160 so that any additional necessary space as well as the power dissipation of the electronic assembly for implementing the inventional features are minimized. In case the relay coil is not energized by current supply, the light-emitting diode 160 can alternatively be supplied with current via the current path over resistor 180 and further supply lines within the integrated circuit from input Vdd to input/output LED leading to the anode of the diode 160. In this case the dimensions of the resistors 100 and 180 have to be modified to lower ohmic values to lighten the LED with sufficient intensity. This allows the light-emitting diode 160 to operate in several operating states, such as a continuously light-emitting status and a flashing status, independently from the switching status of power switch 6. For example, in case a relay with a normally open contact is used, then the diode will be in a continuously light-emitting status when power switch 6 is closed and heating current is flowing. Upon opening switch 6, the diode would normally be dark but can provide a flash signal by being intermittently supplied with current from integrated circuit 200 via resistor 180. In case a relay with a normally closed contact is used, the diode will not receive current from the relay coil when power switch 6 is closed and heating current is flowing and, then, can be supplied with current from integrated circuit 200 via resistor 180 to provide a continuous light signal. Upon opening of switch 6 the diode will receive current from the energized relay coil. The flashing status then can be achieved by intermittently controlling the anode of the diode 160 by means of integrated circuit 200. The intermittent control can, for example, be implemented by intermittently short-circuiting the anode of the light-emitting diode 160 to ground by means of FET 210 comprised in the IC circuit 200. Alternatively, a plurality of light-emitting diodes being optionally controllable independently from each other may be provided.

While there has been shown and described what are at present considered the preferred embodiments of the invention, it will be obvious to those skilled in the art that various changes and modifications can be made therein without departing from the scope of the invention defined by the appended claims. For example, an external thermostatic power switch 7 is provided in the above embodiments. This can be a self-resetting or a not self-resetting temperature switch. Optionally, a plurality of such switches can be provided in series or in parallel to each other and be connected in series to a single internal safety power switch 6. In addition, in the embodiment of FIG. 3, the amplifier for the voltage drop at measuring resistance is integrated in IC-circuit 200. Alternatively, the amplifier for the voltage drop could be provided outside IC-circuit 200. The ASIC could be replaced by embodying the IC-circuit by means of software in form of a microcontroller being freely programmable in its essential features.

What is claimed is:

1. A device for detecting, monitoring and controlling the operating status of an electric flat-iron which is provided with at least one electric heating circuit having a heating element and a first power switch of the flat-iron in the form of a thermostatically controlled ON/OFF switch connected in series to the heating element for controlling the temperature of the electric flat-iron, wherein said device comprises:

a control unit being provided as an integrated circuit;

a second power switch which is controlled by the control unit depending on the operating status of the electric flat-iron and which is connected in series with said electric heating circuit;

an indicator unit having at least one indicator element for indicating the heating status of the electric flat-iron;

a low voltage power supply directly energized by the line voltage supply without galvanic isolation for energizing at least one of said control unit, said indicator unit, and said second power switch;

a low-impedance measuring resistance being connected in series with said second power switch and providing an indirect detection means of the switching status of both power switches;

means for supplying a voltage drop arising at the measuring resistance as an input signal to said control unit for evaluating said input signal with respect to the status of the electric flat-iron; and means for supplying a control signal from said control unit to said indicator element for indicating the present heating status of the electric flat-iron.

2. Device according to claim 1 wherein the indicator element is provided for indicating that a heating current is flowing through said at least one heating element.

3. A device for detecting, monitoring and controlling the operating status of an electric iron which is provided with at least one electric heating circuit having a heating element and a first power switch of the iron connected in series to the heating element, wherein said device comprises:

a control unit being provided as an integrated circuit;

a second power switch which is controlled by the control unit depending on the operating status of the electric iron and which is connected in series with said electric heating circuit;

an indicator unit having at least one indicator element for indicating the heating status of the electric iron;

a low voltage power supply for energizing at least one of said control unit, said indicator unit, and said second power switch;

a low-impedance measuring resistance being connected in series with said second power switch and providing an indirect detection means of the switching status of both power switches, wherein said indicator element is provided for indicating that a desired operating temperature of the iron has been reached after a corresponding predetermined number of ON/OFF-switching cycles of said first power switch have been indirectly detected by means of said low-impedance measuring resistance;

means for supplying a voltage drop arising at the measuring resistance as an input signal to said control unit for evaluating said input signal; and means for supplying a control signal to said indicator element for indicating the present heating status of the electric iron.

4. Device according to claim 1 wherein an amplifier is provided for amplifying the voltage drop at the low-impedance measuring resistance.

5. Device according to claim 4 wherein the amplifier is provided in the integrated control unit.

6. A device for detecting, monitoring and controlling the operating status of an electric iron which is provided with at least one electric heating circuit having a heating element and a first power switch of the iron connected in series to the heating element, wherein said device comprises:

a control unit being provided as an integrated circuit;

a second power switch which is controlled by the control unit depending on the operating status of the electric iron and which is connected in series with said electric heating circuit;

an indicator unit having at least one indicator element for indicating the heating status of the electric iron;

a low voltage power supply for energizing at least one of said control unit, said indicator unit, and said second power switch;

a low-impedance measuring resistance being connected in series with said second power switch and providing an indirect detection means of the switching status of both power switches, wherein the low-impedance measuring resistance, on its one connection side, is connected to circuit ground and, on its other connection side, is connected to a measuring signal input of the control unit;

means for supplying a voltage drop arising at the measuring resistance as an input signal to said control unit for evaluating said input signal; and means for supplying a control signal to said indicator element for indicating the present heating status of the electric iron.

7. A device for detecting, monitoring and controlling the operating status of an electric iron which is provided with at least one electric heating circuit having a heating element and a first power switch of the iron connected in series to the heating element, wherein said device comprises:

a control unit being provided as an integrated circuit;

a second power switch which is controlled by the control unit depending on the operating status of the electric iron and which is connected in series with said electric heating circuit;

an indicator unit having at least one indicator element for indicating the heating status of the electric iron;

a low voltage power supply for energizing at least one of said control unit, said indicator unit, and said second power switch;

a low-impedance measuring resistance being connected in series with said second power switch and providing an indirect detection means of the switching status of both power switches, wherein the low-impedance measuring resistance is formed by a section of a heating current conductor path of the electric heating circuit;

means for supplying a voltage drop arising at the measuring resistance as an input signal to said control unit for evaluating said input signal; and means for supplying a control signal to said indicator element for indicating the present heating status of the electric iron.

8. Device according to claim 1 wherein said indicator unit comprise one or a plurality of light-emitting diodes.

9. Device according to claim 1 wherein the control unit is provided in form of an application specific integrated circuit (ASIC).

10. Device according to claim 1 wherein the control unit is supplied with one or more further input signals from one or a plurality of input signal generating means in form of sensors and timers.

11. Device according to claim 10 wherein an input signal is a signal generated by a sensor sensing position and movement of the electric iron in order to effect shut-off of the heating current via the internal power switch whenever the electric iron has not been manipulated over a predetermined time period.

12. Device according to claim 10 wherein an input signal is a signal generated by a timer in order to effect shut-off of the electric heating circuit by means of the second power switch when a predetermined time period has elapsed after the first power switch had been initially switched ON.

13. Device according to claim 1 wherein said second power switch is an internal power switch.

14. Device according to claim 1 wherein the low-impedance measuring resistance is directly connected to a terminal of the line voltage supply.

15. Device according to claim 1 wherein the impedance value of the low-impedance measuring resistance is selected such that the dissipated power is lower than 1 Watt.

* * * * *